United States Patent [19]

Guillermin et al.

[11] 4,221,833

[45] Sep. 9, 1980

[54] PILE TEXTILE ARTICLE AND PROCESS FOR PREPARATION

[75] Inventors: René Guillermin, Bron; Jean Joly, Craponne; Joseph Puthon, Lyon, all of France

[73] Assignee: Rhone-Poulenc-Textile, Paris, France

[21] Appl. No.: 864,535

[22] Filed: Dec. 27, 1978

[51] Int. Cl.[2] ..... A46B 1/00

[52] U.S. Cl. ..... 428/92; 15/159 R; 156/72; 428/85; 428/62; 428/88; 428/90; 428/95

[58] Field of Search ..... 428/85, 88, 90, 92, 428/95, 62; 156/72; 15/159 R

[56] References Cited

U.S. PATENT DOCUMENTS

| | | | |
|---|---|---|---|
| 1,956,592 | 5/1934 | Rindskopf | 156/72 |
| 3,017,307 | 1/1962 | Halliburton | 156/72 |
| 3,604,043 | 9/1971 | Lewis | 15/159 |
| 3,633,974 | 1/1972 | Lewis | 15/159 |
| 3,641,610 | 2/1972 | Lewis | 15/159 |
| 3,798,699 | 3/1974 | Lewis | 15/179 |
| 3,904,799 | 9/1975 | Shorrock | 428/92 |

FOREIGN PATENT DOCUMENTS

| | | | |
|---|---|---|---|
| 2531726 | 7/1975 | Fed. Rep. of Germany | 428/95 |
| 579015 | 7/1946 | United Kingdom | 156/72 |

*Primary Examiner*—Marion McCamish
*Attorney, Agent, or Firm*—Sherman & Shalloway

[57] ABSTRACT

A plurality of substantially parallel filamentary textile materials are assembled in a bundle to make a textile pile element. One end of the bundle has a base joining the materials at one end in a stable condition whereas the other end of the bundle contains strands which are free and open. The textile materials are retained in parallel arrangement by the base which is located in a mesh. The mesh is a support comprised of a planar structure having openings for receiving the bases of the elements. The mesh may be prefabricated or assembled during fabrication of the pile article. A pile textile article is made from the elements by a process of fabrication which includes the steps of inserting the textile elements in the opening in the mesh to result in an article which has application to furniture, clothing, toys, hats and decorative items.

32 Claims, 7 Drawing Figures

PILE TEXTILE ARTICLE AND PROCESS FOR PREPARATION

BACKGROUND OF THE INVENTION

1. Field of the Invention

The invention relates generally to pile textile articles and a process for their fabrication. In particular, the field of the invention is concerned with articles and a method of making articles from textile strand bundles inserted into a support such as a mesh for application to furniture, clothing, hats, toys and similar decorative items.

2. Description of the Prior Art

The prior art generally discloses many examples of processes to make articles and articles of pile, woven, knitted or pique textile materials. In general, these articles are made by a process employing a bulky apparatus requiring a large initial cost. From an economic view point, numerous articles have to be made to amortize the equipment and allow the sale of the articles at acceptable prices for the consumer.

On the other hand, the consumer does have the ability to make and assemble the articles. The disclosed invention will allow the consumer to reasonably make the article at home in the form of decorative items.

One technique known in the prior art to provide the pile textile articles is to affix the pile to a canvas. In general, a tuft of strands or fibers is inserted in a fabric. The fibers are open on both sides initially. After assembly with the fabric, adhesive is applied to the rear side of the fibers and the fabric to assure proper attachment. The drawbacks from such a procedure include the difficulty of introducing a tuft of fibers in a fabric. In addition, there is a further drawback in that it is difficult and non-uniform to apply adhesive to the back side of the fabric and the open ends of the tuft of fibers.

Alternatively, individual strands can be tied to a fine mesh, but this is a slow and time-consuming process.

Another prior art technique teaches mounting the pile textile elements on a gauze with square meshes. The pile elements are arranged upside-down. The base is arranged at the top and embedded in a fusible plasic associated with the gauze by application of heat.

SUMMARY OF THE INVENTION

It is an object of the invention to provide a process for assembling pile articles which is simple and economical.

It is a further object of this invention to provide a textile pile article characterized in that it is made up of shaggy textile elements organized in a support mesh.

It is a further object of this invention to provide a pile textile article which employs the use of elements consisting of a bundle of filamentary textile materials having one end thereof in a fixed and stable condition so that the elements can be easily supported by a mesh.

It is yet another object of this invention to describe a process for fabrication of pile textile articles characterized in that shaggy textile elements are inserted by their bases into a support mesh, the bases assuring the locking of the element into the mesh.

BRIEF DESCRIPTION OF THE DRAWING

These and other objects will become apparent to those skilled in the art by referring to the drawings in which.

DETAILED DESCRIPTION OF THE PREFERRED EMBODIMENT

Figure 1:
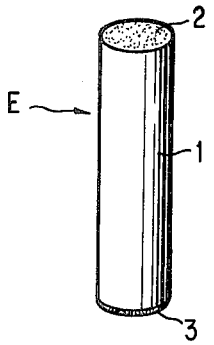
FIG. 1 is an oblique view of a shaggy textile element having a wrapping thereon.

The process and apparatus of the disclosed invention which results in pile textile articles is based on the use of a shaggy textile element as shown in FIG. 1. The element E is comprised of a bundle of textile strands or filamentary textile material 2 which are substantially in parallel arrangement. One end of the strands forms a base 3 which is comprised of strands fixed together in a stable condition providing a support for retaining the strands in a stable substantially parallel, organized manner. The other end of the bundle of strands is open and free. A wrapper 3 made of any convenient material such as paper, film or crepon is disposed around the strands so that the strands are substantially held in a shape which has a diameter similar to base 3.

Figure 2:
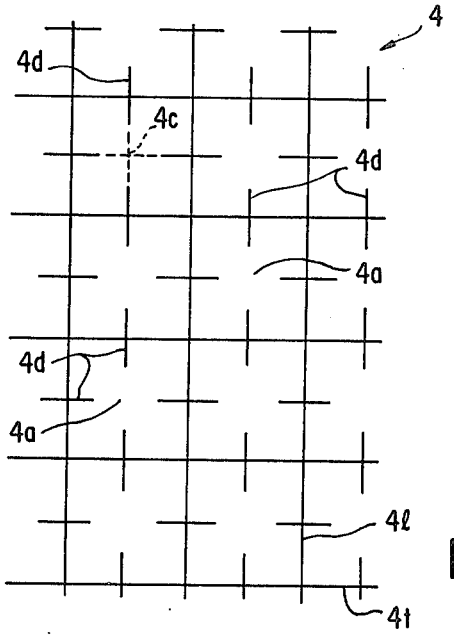
FIG. 2 is a top planar view of an embodiment of a support mesh.

In FIG. 2, a support grill or mesh 4 is shown. The mesh 4 is composed of a plurality of substantially parallel longitudinal members 4*l* and substantially parallel transverse members 4*t*, intersecting perpendicularly. The openings 4*a* in the mesh are adapted to receive the base of the element E in order to allow the mesh to support a series of elements so that a pile textile article can be created from the support mesh 4. In particular, the support mesh can be of any convenient material such as textile, metal, plastic or a combination of these materials. The properties of the support mesh may be resilient, flexible, rigid, articulated or elastic, depending on the type of material selected, the mode of construction of the mesh and the type of article and use for which the resulting mesh and elements will be applied. It is also possible to allow the mesh to be constructed of a material which is retractable.

The shape of the openings 4 should be able to receive the base 3. Basically, the shape 4*a* is dependent upon the type of element E and the type of article from which the assembled mesh will be created. Suggested shapes for the opening 4*a* include square, rectangular, round, hexagonal, etc. In addition, the mesh may be uniform as shown in FIG. 2 or may include openings 4*a* which have different sizes and shapes to be adapted according to the type of article for which the completed mesh will be applied.

The process for assembling the elements E in the mesh 4 is as follows. The textile element E is inserted into the opening 4*a* formed by the mesh 4 so that the element is wedged and the base is held in place. The wrapping is then removed to permit the free opening of the textile strands or fibers 2 located at the top end of the element E. The insertion can, of course, also be performed after having removed the wrapping. The base 3 of the shaggy textile element E is sufficiently flexible so that it can be deformed and will easily enter the opening 4a. In addition, the base has sufficient rigidity and resiliency so that once it is in position in the opening 4a, the base 3 retains the element E in place.

As an alternative, it is also possible to perform the implantation of the elements E into the mesh 4 by removing or deforming the meshes 4. For example, it is possible to cut the junction points 4c of the mesh 4 at certain indicated positions to form catches 4d which hold the base of the implanted element E.

Figure 3:
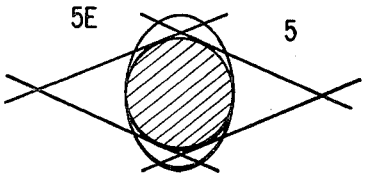
FIG. 3 is a bottom cross-sectional view of a base inserted in another embodiment of a support mesh.

Another embodiment which may be adapted to the mesh to allow implantation of the elements E is a button/button hole type of arrangement. One way this can be achieved is by using a mesh with diamond shaped meshes 5 as shown in FIG. 3. The diamond mesh 5 has parallel longitudinal and parallel transverse members which intersect at an angle as opposed to the perpendicular intersection of mesh 4. In this case, the oblong elements 5E would have bases of an oblong or eliptical shape. The oblong element 5E would be implanted within the opening by matching the greatest diagonal of the opening in the diamond mesh 5E to the largest width of the oblong element E and then turning the element one-quarter turn or 90° within the diamond mesh 5 to lock the element within the mesh 5. FIG. 3 shows the oblong element 5 in the locked position with respect to the diamond mesh 5E.

Figure 4:
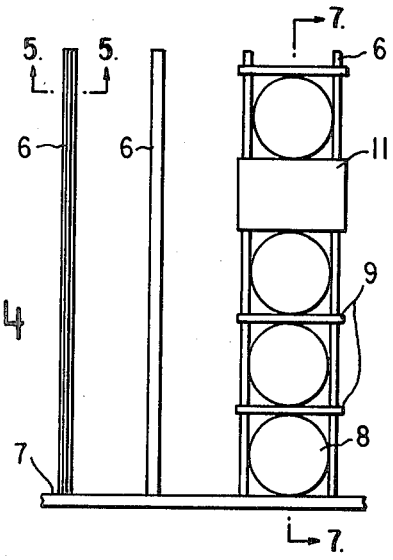
FIG. 4 is a bottom planar view of a third embodiment of a support mesh having shaggy textile elements located therein.
Figure 5:
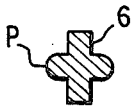
FIG. 5 is a cross-sectional view taken along line 5—5 of FIG. 4.

The process described above is based on the fact that the mesh may be a prefabricated grill. It is also possible to make pile textile articles from the elements E by applying and assembling a mesh to the shaggy textile elements as they are inserted within a mesh. This type of embodiment is illustrated in FIG. 4. Filiform strands 6, which are hair like strands, are held in parallel relation to one another like a warp of a yarn during weaving by a hooking means 7. The base of a shaggy textile element 8 is inserted between two parallel strands 6. A means joining the strands 6 allows the base 3 to be locked in position. Specifically, the base is locked and blocked into position by a slide or hook 9 which bridges the strands 6. The slide may be prethreaded to the strands 6 before implantation of the elements. Thus, a mesh is created with each insertion of a shaggy textile element. Additional elements are inserted between the strands 6 and locked into place by slides 9 in order to form an array. Depending on the type of pile textile article and its use, the arrays may be prefabricated by rows or columns or may be progressively assembled. In particular, a series of elements E may have bases which are joined together in a line so that the entire line of elements can be inserted between a pair of parallel strands 6.

Figure 6:
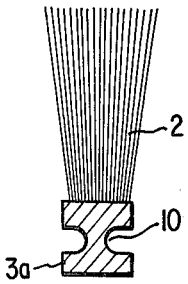
FIG. 6 is a side view of a shaggy textile element having a base portion attached thereto.
Figure 7:
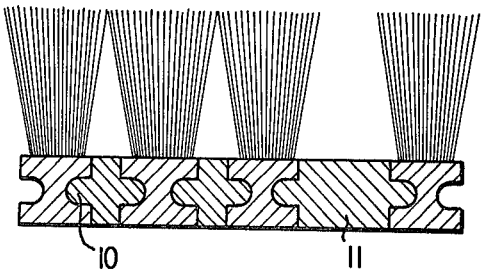
FIG. 7 is a cross-sectional view taken along line 7—7 of FIG. 4 having the shaggy textile elements of FIG. 6.

In another embodiment of a mesh, which can be assembled as implantation of the elements E occurs, the strands 6 can be provided with a specific shape or cross-section which will mate with the base or shape of the element E. For example, the strands 6a have protrusions P on either side. In this case, the shaggy textile element E would have a plastic base comprising a circular shaped groove 10 on either side as shown in FIG. 6. This would allow the base 3a to be implanted between the strands 6 and the groove 10 would mate with the protrusion P. In effect, the structure is as if the element base 3a is slid onto rails formed by strands 6. In such a situation, the elements could be joined to the proceeding and following one or could be separated from one another by a blank plastic spacer 11 as shown in FIG. 7. This blank element 11 would be used in a situation where the textile strands 2 forming the element have a wide dispersion at their open end and would not require immediate adjacent assembly. The implantation of the spacer 11 can be performed on either side of the base of the elements or on both sides, dependent upon the thickness of the shaggy elements at the open end and the desired design or application.

In the above embodiments, the textile elements can be fastened either for permanent fixation to the mesh, or in a removable manner so that they may be adjusted or replaced. This offers a distinct advantage over the present state of the art pile textile articles in which the piles are stitched or glues on a support. For example, in a case of high wear or areas which become soiled and cannot be cleaned, the elements may be replaced to correct the problem. On the other hand, it is also possible to join the bases of the assembled elements together by fusing or glueing to provide a sturdy single unit.

It is also possible to join the underside of an assembled mesh by coating or glueing the implanted bases to another flexible support or structure such as a chair or frame. Thus achieved is an easy manual or machine adaptable process which provides shaggy textile articles of piles which are for application to floor and wall coverings, tapestry, decorative articles, paint rollers, toys, furniture, bedding, hats, etc.

The implantation or insertion of the bases may be performed on a single side of the mesh or both sides of the mesh depending on the thickness of the elements and the desired design or application.

The following examples illustrates the present application of the above-described article and process.

EXAMPLE 1—FLOOR COVERING

Shaggy textile elements for use in floor coverings can be used by applying elements made of the following characteristics:

5 centimeters in length and 1 centimeter in diameter.

The element is made up of 50 yarns. Each yarn is comprised of a two-piece twist of polyhexamethylene adipamide of 2800 dtex/136 strands each. Each yarn of two pieces is twisted 100 turns in the Z direction and 100 turns in the S direction.

Each element is wrapped in crepon paper and one end of the yarns of each of the shaggy textile elements is fused together to form a base by such means as heat fusion. This fusion can be obtained at the time of fabrication by heat fusion cutting in5 centimeter lengths. The shaggy textile elements are inserted by their base into an extruded mesh which is comprised of a 10 millimeter square mesh of polypropylene. The textile elements are wedged into the mesh by their base. The resulting mesh of implanted elements can be applied as a floor covering.

EXAMPLE 2—WALL TAPESTRY

For application as a tapestry, shaggy textile elements representing the following characteristics are used:

3 centimeters in length and 0.7 centimeters in diameter.

The elements are made up of 40 continuous yarns of polyhexamethylene adipamide of 2800 dtex/136 strands each, the unit being wrapped with crepon paper. The base of the shaggy textile element is fused by a method such as heat fusion during fabrication wherein heat fusion and cutting is performed in three centimeter lengths.

The shaggy elements are inserted by their base in an extruded mesh of polypropylene with square meshes which are flexible and in the dimensions of 6 millimeters per side. The mesh includes strands having cut off portions as shown in FIG. 2 which hold the base of a shaggy textile element in place. Thus, a wall tapestry can easily be made by an individual by using elements of different colors.

What is claimed is:

1. A method of making pile textile articles comprising the steps of:
   (a) providing a plurality of textile pile elements, each comprised of a bundle of a plurality of substantially parallel filamentary textile materials having a base joining the materials at one end;
   (b) providing a mesh comprised of an extruded planar structure having a plurality of openings therein for receiving the elements; and
   (c) inserting the elements into the openings in the mesh so that the bases are held within the opening.

2. The method of claim 1 wherein each element includes a wrapper around the filamentary textile materials and said method includes the step of removing the wrapper after the elements are inserted into the openings.

3. The method of claim 1 wherein the openings are in a diamond shape and the bases of the elements are in an oblong shape and said method includes the step of turning the bases after inserting in the openings to lock the bases in position.

4. The method of claim 1 wherein the mesh has catches which extend into the openings and said method further includes the step of engaging the catches with the bases to retain the bases of the elements when the elements are inserted into the opening.

5. The method of claim 1 wherein the extruded mesh is comprised of a plurality of parallel strands each having a protrusion and the bases of the elements include a groove for receiving the protrusion.

6. The method of claim 1 including the step of joining the bases of the elements together after inserting into the openings.

7. The method of claim 6 further including the step of attaching the bases to a flexible support.

8. The method of claim 1 further including the step of attaching the bases to a flexible support.

9. the method of claim 1 further including the step of selectively inserting the elements from either side of the mesh.

10. The method of claim 1 wherein said mesh is comprised of a plurality of substantially parallel longitudinal members and substantially parallel transverse members perpendicularly intersecting said longitudinal members forming openings therebetween said members joined at the point of intersection.

11. The method of claim 1 wherein the mesh is comprised of extruded polypropylene.

12. A textile pile article comprising:
   (a) a plurality of textile pile elements comprised of a plurality of substantially parallel textile materials having a base joining the materials at one end; and
   (b) an extruded mesh comprised of a plurality of substantially parallel longitudinal members and substantially parallel transverse members intersecting said longitudinal members forming openings therebetween, said members joined at the point of intersection, said base located within the opening of the mesh and being supported by said longitudinal members and said transverse members.

13. The textile pile article of claim 12 wherein each element includes a wrapper around the filamentary textile materials.

14. The textile pile article of claim 12 wherein the openings in said mesh are in a diamond shape and wherein the bases of said elements have an oblong cross-section.

15. The textile pile article of claim 12 wherein said mesh has catches which extend into the openings, said catches for retaining the bases of said elements located within the opening.

16. The textile pile article of claim 12 wherein said longitudinal members are perpendicular to said transverse members.

17. The article of claim 12 wherein each said longitudinal member has a protrusion and each base includes a groove therein for receiving said protrusion.

18. The article of claim 12 wherein the bases of the elements are joined together.

19. The article of claim 18 wherein said bases are attached to a flexible support.

20. The articles of claim 12 wherein said bases are attached to a flexible support.

21. The article of claim 12 wherein adjacent elements extend from alternative sides of the mesh.

22. The article of claim 12 wherein the mesh is comprised of extruded polypropylene.

23. A method for making a mesh having openings for use in assembling pile textile articles which are assembled by inserting a plurality of pile textile elements having a plurality of substantially parallel filamentary textile materials with a base for retaining an end of said material in a stable condition into the opening in the mesh, said method comprising the steps of:
   (a) providing an extruded structure having substantially parallel longitudinal members and substantially parallel transverse members intersecting said longitudinal members forming junction points and openings therebetween; and
   (b) cutting selective longitudinal members and selective transverse members at selective junction points forming catches from the cut members which will engage the bases of the textile elements which are inserted in openings formed in the extruded mesh.

24. The method of claim 23 wherein said extruded structure is an extruded polypropylene mesh.

25. A method of making pile textile articles comprising the steps of:
   (a) providing a plurality of textile pile elements, each comprised of a bundle of a plurality of substantially parallel filamentary textile materials having a base joining the materials at one end;
   (b) providing a mesh comprised of a plurality of spaced parallel strands having openings therebetween for receiving the elements;
   (c) inserting the elements into the openings in the mesh so that the bases are held within the opening; and
   (d) placing a bridge means across the strands after the element is inserted in the opening formed between the strands.

26. The method of claim 25 including the step of joining the bases of the elements together after inserting into the openings.

27. The method of claim 25 wherein said bridge means are prethreaded on the strands and said method includes the step of sliding the bridge means adjacent to the base of the element so that the element is held in position.

28. The method of claim 25 including the step of inserting spacers between the base of the elements.

29. A textile pile article comprising:

(a) a plurality of textile pile elements comprised of a plurality of substantially parallel textile materials having a base joining the materials at one end;

(b) a mesh comprised of a plurality of substantially parallel longitudinal members and substantially parallel transverse members intersecting said longitudinal members forming openings therebetween, said base located within the opening of the mesh and being supported by said longitudinal members and said transverse members; and (c) said transverse members comprised of bridging means which are perpendicular to said longitudinal members and connect adjacent longitudinal members retaining the base of said element located in the opening between the longitudinal members.

30. The articles of claim 29 wherein said bridging means are threaded onto said longitudinal members.

31. The article of claim 29 wherein each said longitudinal member has a protrusion and each base includes a groove therein for receiving said protrusion.

32. The article of claim 29 wherein a spacing means is inserted between adjacent bases.

* * * * *

UNITED STATES PATENT AND TRADEMARK OFFICE

CERTIFICATE OF CORRECTION

PATENT NO. : 4,221,833

DATED : September 9, 1980

INVENTOR(S) : GUILLERMIN, ET AL.

It is certified that error appears in the above—identified patent and that said Letters Patent is hereby corrected as shown below:

Please add the following priority document:

French Application No. 76/39518, filed December 27, 1976

On the cover sheet, Item (22) should read

-- Dec. 27, 1977 --.

Signed and Sealed this

*Sixth* Day of *January 1981*

[SEAL]

*Attest:*

SIDNEY A. DIAMOND

*Attesting Officer*

*Commissioner of Patents and Trademarks*